US006571520B2

(12) United States Patent
Koenig, Jr. et al.

(10) Patent No.: US 6,571,520 B2
(45) Date of Patent: Jun. 3, 2003

(54) DRYWALL-TRIMMING STRIP HAVING BULLNOSE PORTION WITH MINIMAL SET-BACK REQUIREMENT

(75) Inventors: Joseph M. Koenig, Jr., Glenview, IL (US); Mark Budzik, Niles, IL (US)

(73) Assignee: Trim-Tex, Inc., Lincolnwood, IL (US)

( * ) Notice: Subject to any disclaimer, the term of this patent is extended or adjusted under 35 U.S.C. 154(b) by 0 days.

(21) Appl. No.: 09/812,604

(22) Filed: Mar. 20, 2001

(65) Prior Publication Data

US 2002/0134035 A1 Sep. 26, 2002

(51) Int. Cl.[7] ..... E04B 2/00

(52) U.S. Cl. ..... 52/287.1; 52/273; 52/276; 52/277; 52/255; 52/256

(58) Field of Search ..... 52/272, 273, 276, 52/277, 256, 255, 257, 287.1, 288.1

(56) References Cited

U.S. PATENT DOCUMENTS

| | | | | | |
|---|---|---|---|---|---|
| 3,717,968 | A | * | 2/1973 | Olsen et al. | 52/288 |
| 4,843,771 | A | * | 7/1989 | Chapman et al. | 52/288 |
| 5,740,642 | A | * | 4/1998 | Koenig et al. | 403/267 |
| 5,904,016 | A | * | 5/1999 | Koenig et al. | 52/255 |
| 6,119,420 | A | * | 9/2000 | Koenig et al. | 52/255 |
| 6,212,836 | B1 | * | 4/2001 | Larson | 52/255 |
| 6,295,776 | B1 | * | 10/2001 | Kunz et al. | 156/153 |
| 6,438,914 | B1 | * | 8/2002 | Robertson | 52/255 |

FOREIGN PATENT DOCUMENTS

| | | | | |
|---|---|---|---|---|
| DE | 0634537 A2 | * | 6/1994 | E04F/13/06 |
| EP | 0634537 A2 | * | 6/1994 | E04F/13/06 |

OTHER PUBLICATIONS

Trim–Tex, Inc., 1997–1998 Catalog, Lincolnwood, Illinois—see pp. 18, 19, 21, 24, 25 and 26.

* cited by examiner

*Primary Examiner*—Carl D. Friedman
*Assistant Examiner*—Chi Q Nguyen
(74) *Attorney, Agent, or Firm*—Wood, Phillips, Katz, Clark & Mortimer

(57) ABSTRACT

As extruded from a polymeric material, such as polyvinyl chloride, a drywall-trimming strip has a central portion, which has a bullnose region and two planar regions, one at each side of the bullnose portion. Further, the drywall-trimming strip has two lateral flanges, each of which is joined unitarily to the bullnose portion by a stepped junction. The bullnose region has an exterior radius of 0.350 inch approximately. Each planar region has a width of 0.217 inch approximately, as measured in a plane normal to an axis defined by the bullnose region. Each junction has a measurement of 0.095 approximately, as measured between a plane defined by the exterior surface of the bullnose portion and a plane defined by the interior surface of the flange at such junction. Having a thickness of 0.055 inch approximately, the strip is adapted to fit along an elongate corner defined by two drywall panels, each of which has a thickness not less than 0.5 inch approximately and each of which is disposed against an interior surface of one of the lateral flanges, while permitting a first panel to abut or to be closely spaced from a second panel without requiring the second of panel to be set back from a plane defined by an outer surface of the first panel, by a distance larger then 0.091 inch approximately, so as to avoid interference with the bullnose portion.

2 Claims, 1 Drawing Sheet

DRYWALL-TRIMMING STRIP HAVING BULLNOSE PORTION WITH MINIMAL SET-BACK REQUIREMENT

FIELD OF THE INVENTION

This invention pertains to improvements in a drywall-trimming strip of a type extruded from a polymeric material, such as polyvinyl chloride, and having a central portion having a bullnose region and two lateral flanges, each being joined unitarily to the central portion by a stepped junction.

BACKGROUND OF THE INVENTION

Conventionally, in the United States, a drywall panel has a thickness of 0.5 inch approximately or a thickness of 0.625 inch approximately. Heretofore, drywall-trimming strips of the type noted above have been used widely in residential and commercial buildings and have been available commercially from Trim-Tex, Inc. of Lincolnwood, Ill., and from other sources. Commonly, as known heretofore, the central portion of such a strip has a bullnose profile having an exterior radius of not less than 0.75 inch approximately, which radius continues to the stepped junction joining each of the lateral flanges to the central portion.

When a drywall-trimming strip, as described in the preceding paragraph, is fitted along an elongate corner defined by two drywall panels, which may be conveniently called a first panel and a second panel, so that each of the drywall panels is disposed against an interior surface of one of the lateral flanges, and so that the first panel approximately butts against the second panel, the second panel is required to be set back from a plane defined by an outer surface of the first panel, by a sufficient distance to avoid interference between the second panel and the bullnose portion of the drywall-trimming strip.

If the bullnose region of the central portion has an exterior radius of 0.750 inch approximately, if each stepped junction has a measurement of 0.095 inch approximately, as measured between the exterior surface of the bullnose portion and the interior surface of whichever of the lateral flanges is joined by said stepped junction, and if drywall-trimming strip has a thickness of 0.055 inch approximately, a sufficient distance for the second panel to be set back is 0.398 inch approximately, which does not allow the bullnose portion to be well supported by the second panel, against damage from exterior blows.

SUMMARY OF THE INVENTION

This invention provides a drywall-trimming strip of the type noted above, extruded from a polymeric material, such as polyvinyl chloride, and having a central portion having a bullnose region between two planar regions, which are novel in a drywall-trimming strip. As before, the drywall-trimming strip has two lateral flanges, each of which is joined unitarily to the central portion by a stepped junction. As before, each stepped junctions has a measurement of 0.095 inch approximately, as measured between a plane defined by the exterior surface of the bullnose portion and a plane defined by the interior surface of whichever of the lateral flanges is joined unitarily to the bullnose portion by said stepped junction. As before, the drywall-trimming strip has a thickness of 0.055 inch approximately, as measured between the exterior and interior surfaces of the bullnose portion and as measured between the exterior and interior surfaces of each of the lateral flanges.

This invention contemplates that, between the planar regions of the central portion, the bullnose region of the central portion has an exterior radius in a range between 0.200 inch approximately and 0.350 inch approximately and that each of the planar regions has a width of 0.217 inch approximately, as measured in a plane normal to an axis defined by the bullnose region. Thus, the drywall-trimming strip is adapted to fit along an elongate corner defined by a first drywall panel and a second drywall panel, so that each drywall panel is disposed against an interior surface of one of the lateral flanges and so that the first drywall panel is permitted to abut or to be closely spaced from the second drywall panel, without requiring the second drywall panel to be set back from a plane defined by an outer surface of the first drywall panel, by a distance larger than 0.091 inch approximately, so as to avoid interference between the second panel and the bullnose portion of the drywall-trimming strip.

This invention also provides a combination of a drywall-trimming strip, as described in the preceding paragraph, a first drywall panel, and a second drywall panel, each drywall panel having a thickness not less than 0.5 inch approximately. The first and second drywall panels define an elongate corner, along which the drywall-trimming strip is fitted, along which the first drywall panel abuts or is spaced closely from the second drywall panel, and along which the second drywall panel is set back from a plane defined by an outer surface of the first drywall panel, by a distance as small as 0.091 inch approximately, without interference between the second drywall panel and the bullnose portion of the drywall-trimming strip.

In the preceding summary of this invention, in the following description of a preferred embodiment of this invention, and in the accompanying claims, "approximately" means ±0.005 inch.

DETAILED DESCRIPTION OF THE PREFERRED EMBODIMENT

Figure 1:
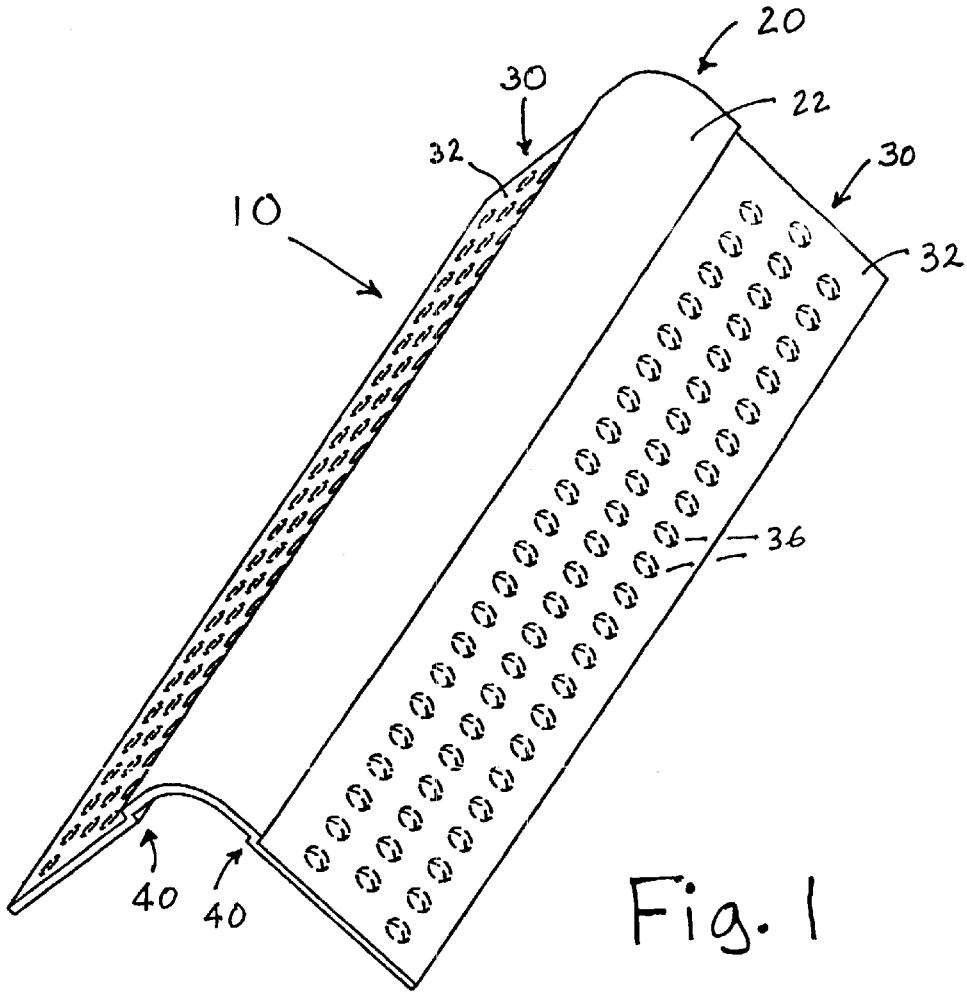
FIG. 1 is a perspective view of a drywall-trimming strip constituting a preferred embodiment of this invention.
Figure 2:
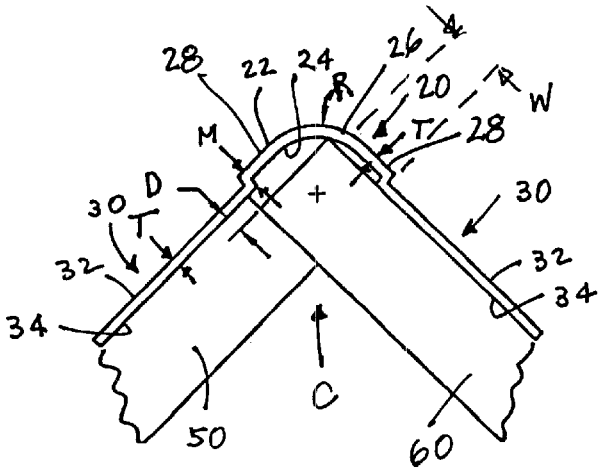
FIG. 2 is a profile view of the drywall-trimming strip shown in FIG. 1, as combined with two drywall panels in a manner contemplated by this invention, whereby one drywall panel is set back by a minimal distance.

As shown in FIGS. 1 and 2, a drywall-trimming strip 10 is a one-piece extrusion of a polymeric material, such as polyvinyl chloride, which is preferred. The drywall-trimming strip 10 has a central portion 20 and two lateral flanges 30. The central portion 20 has an exterior surface 22 and an interior surface 24 and each lateral flange 30 has an exterior surface 32 and an interior surface 34. Each lateral flange 30 has an array of circular holes, elongate slots, or other apertures, such as the circular holes 36 shown in broken lines in FIG. 1.

As novel features of this invention, the central portion 20 has a bullnose region 26 and two planar regions 28, one at each side of the bullnose region 26. Each lateral flange 30 is joined unitarily to one of the planar regions 28 of the central portion 20, by a stepped junction 40.

As shown in FIG. 2, the drywall-trimming strip 10 is fitted along an elongate corner C defined by a first drywall panel 50 and a second drywall panel 60. The elongate corner C may be a vertical, inclined, or horizontal corner. Each of the drywall panels 50, 60, may have a thickness of 0.5 inch approximately, a thickness of 0.625 inch approximately, or some other thickness not less than approximately 0.5 inch.

As shown in FIG. 2, the drywall-trimming strip 10 is fitted along the elongate corner C, so that each of the drywall panels 50, 60, is disposed against the interior surface 34 of one of the lateral flanges 30 and so that the first drywall panel 50 abuts, as shown, or is spaced closely from the second drywall panel 60. The second drywall panel 60 is required to be set back from a plane defined by an outer surface 52 of the first drywall panel 50, by a distance D, so as to avoid interference between the second drywall panel 60 and the bullnose region 26 of the central portion 20 of the drywall-trimming strip 10.

According to this invention, the bullnose region 26 of the central portion 20 has an exterior radius R in a range between 0.200 inch approximately and 0.350 inch approximately and each planar region 28 has a width W of 0.217 inch approximately, as measured in a plane normal to an axis defined by the bullnose region 26. Moreover, each stepped junction 40 has a measurement M of 0.095 inch approximately, as measured between a plane defined by the exterior surface of the bullnose portion and a plane defined by the interior surface of whichever of the lateral flanges is joined unitarily to the bullnose portion by said stepped junction. Furthermore, the drywall-trimming strip 10 has a thickness T of 0.055 inch approximately, as measured between the exterior and interior surfaces 22, 24, of the bullnose portion 20 and as measured between the exterior and interior surfaces 32, 34, of each of the lateral flanges 30.

Accordingly, the second drywall panel 60 is not required to be set back from a plane defined by an outer surface 52 of the first drywall panel 50, by a distance D larger than 0.091 inch approximately, so as to avoid interference between the second drywall panel 60 and the bullnose portion 20 of the drywall-trimming strip 10. Consequently, and advantageously, the bullnose portion 20 can be well supported by the second drywall panel 60, against damage from exterior blows.

For an exterior radius R of 0.350 inch approximately, a set-back distance D of 0.091 inch approximately is required. For an exterior radius R of 0.200 inch approximately, the set-back distance that is required is nil. For an exterior radius R between 0.200 inch approximately and 0.350 inch approximately, a set-back distance D more than nil but less than 0.091 inch approximately is required. An exterior radius less than 0.200 inch approximately is not regarded as a bullnose radius.

What is claimed is:

1. A wall corner comprising:

first and second drywall panels, each of said panels having a thickness X not less than about 0.5 inch, said first and second drywall panels being at an angle relative to each other and in an abutting or closely spaced relationship to define an elongated corner, with said second drywall panel overlapping with an end of said first drywall panel through a distance $O_v$, where $O_v$ is up to X −0.091 inch; and a drywall trimming strip which is an extrusion of a polymeric material, the strip having a central portion which has a bullnose region and two planar regions, one at each side of the bullnose region, the drywall trimming strip having two lateral flanges, each of which is joined unitarily to one of the planar regions of the central portion by a stepped junction, the central portion having an exterior surface and an interior surface and each lateral flange having an exterior surface and an interior surface, wherein the bullnose region of the central portion has an exterior radius in a range between about 0.200 inch and about 0.350 inch, each of the planar regions has a width of about 0.217 inch, as measured in a plane normal to the axis defined by the bullnose region, each stepped junction has a measurement of 0.095 inch approximately, as measured between a plane defined by the exterior surface of the bullnose portion and a plan defined by the interior surface of whichever of the lateral flanges is joined unitarily to the bullnose portion by said stepped junction, wherein the drywall-trimming strip has a thickness of 0.055 inch approximately, as measured between the exterior and interior surfaces of the bullnose portion and as measured between the exterior and interior surfaces of each of the lateral flanges, and the drywall-trimming strip is secured along said elongated corner defined by the first drywall panel and the second drywall panel with each drywall panel disposed against an interior surface of one of the lateral flanges with the first drywall panel abutting or to be closely spaced from the second drywall panel, and the second drywall panel set back from a plane defined by an outer surface of the first drywall panel by a distance as small as about 0.091 inch so as to avoid interference between the second drywall panel and the bullnose portion of the drywall-trimming strip.

2. A method of forming a wall corner according to claim 1, comprising the steps of:

securing said first and second drywall panels at an angle relative to one another, whereby said second dry wall panel overlaps said first panel up to X −0.091 inch;

securing said drywall trimming strip to said elongated corner with one of said lateral flanges having an interior surface secured to said first drywall panel and the other of said lateral flanges having an interior surface secured to said second drywall panel.

* * * * *

Disclaimer

6,571,520—Joseph M. Koenig, JR., Glenview, IL (US); Mark Budzik, Niles, IL (US). DRYWALL-TRIMMING STRIP HAVING BULLNOSE PORTION WITH MINIMAL SET-BACK REQUIREMENT. Patent dated Jun. 3, 2003. Disclaimers filed Jan. 13, 2006, by the assignee, Trim-Tex, Inc.

Hereby enters this disclaimer to all claims, of said patent.

*Official Gazette, March 21, 2006*